US009435530B2

(12) United States Patent
Arik et al.

(10) Patent No.: US 9,435,530 B2
(45) Date of Patent: Sep. 6, 2016

(54) OPTOTHERMAL LED LIGHTING FOR HIGH LUMEN EXTRACTION AND EXTENDED LIFETIME

(71) Applicants: Mehmet Arik, Istanbul (TR); Enes Tamdogan, Istanbul (TR)

(72) Inventors: Mehmet Arik, Istanbul (TR); Enes Tamdogan, Istanbul (TR)

(73) Assignee: OZYEGIN UNIVERSITESI, Istanbul (TR)

( * ) Notice: Subject to any disclaimer, the term of this patent is extended or adjusted under 35 U.S.C. 154(b) by 163 days.

(21) Appl. No.: 14/183,964

(22) Filed: Feb. 19, 2014

(65) Prior Publication Data

US 2015/0233564 A1 Aug. 20, 2015

(51) Int. Cl.

| | |
|---|---|
| ***F21V 29/00*** | (2015.01) |
| ***F21V 29/52*** | (2015.01) |
| ***F21V 29/51*** | (2015.01) |
| *F21V 29/74* | (2015.01) |
| *F21K 99/00* | (2016.01) |
| *F21V 29/67* | (2015.01) |
| *F21Y 101/02* | (2006.01) |

(52) U.S. Cl.

CPC ..... *F21V 29/52* (2015.01); *F21V 29/51* (2015.01); *F21K 9/56* (2013.01); *F21V 29/67* (2015.01); *F21V 29/74* (2015.01); *F21Y 2101/02* (2013.01)

(58) Field of Classification Search

CPC ..... F21V 29/51; F21V 29/74; F21V 29/76; F21V 29/83

See application file for complete search history.

(56) References Cited

U.S. PATENT DOCUMENTS

2004/0213016 A1* 10/2004 Rice ..... F21S 48/328 362/547
2009/0001372 A1* 1/2009 Arik ..... C09K 5/10 257/58

FOREIGN PATENT DOCUMENTS

CN 203099570 U 7/2013
KR 20130061142 A 6/2013

* cited by examiner

*Primary Examiner* — Andrew Coughlin
(74) *Attorney, Agent, or Firm* — Deris Patents & Trademarks Agency

(57) ABSTRACT

A lighting system has a dielectric cooling fluid which directly contacts with an LED chip; contacts with the heat sink base by moving towards the heat sink base, i.e. upwards, with the decreasing density as a result of the increased temperature due to the high temperature formed in the LED chip; at the same time the temperature thereof decreasing upon contacting with the heat sink base; moves towards the LED chip, and reduces the temperature of the LED chip by contacting the LED chip upon said movement; and movement channels through which the cooling fluid in gaseous or liquid phase passes during the movement of said cooling fluid.

20 Claims, 7 Drawing Sheets

OPTOTHERMAL LED LIGHTING FOR HIGH LUMEN EXTRACTION AND EXTENDED LIFETIME

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to an embodiment which cools down LED lamps efficiently, and to the integration of the cooling system with the LED lamp.

2. Description of Related Art Including Information Disclosed Under 37 CFR 1.97 and 37 CFR 1.98.

Various cooling methods are used in different LED lamp types (especially in lamps having different power and light intensity). The general aim of all these cooling methods is to prevent the problems that are likely to occur doe to the high heat formed during operation. For example, in a simple LED lamp, a heat sink that performs heat rejection from the lamp surface by convection by means of passive cooling technique is generally used (active cooling methods might as well be used). This heat sink is typically made of metal. However, such cooling methods are not sufficient in case of using lamps with high power and light intensity. Therefore, more efficient methods are needed. In such eases, the surface of heat sinks is cooled down by a fan.

In particular, passive heat sinks of the LEDs used in lighting field provide cooling in direct proportion to the increasing surface areas. However, as in any field, achieving the desired (smaller and lower) size and weight is also required in the field of lighting. Moreover, the existing standards limit the size of these heat sinks. Hence, this technique cannot provide sufficient cooling in the lamps having a power value above a certain value, especially because of limited size. Although these values can be optimized to some extent by means of cooling methods with forced convection, the so called active cooling process, e.g. fans, they will not be sufficient beyond certain power values, besides causing increased cost. Therefore, due to the fact that the existing passive methods cannot provide the desired cooling and possible active methods lead to increased costs, the simple and efficient cooling method according to the invention has been developed. In addition, the cooling technique disclosed herein is the only and most efficient solution for solving the problem of hot spots formed both in the chips of LED systems where a plurality of LED chips are used, and in the phosphor used for changing color in LEDs.

The patent search carried out regarding the prior art revealed the Chinese patent application No. CN203099570 dated Mar. 19, 2013. This application discloses an air-cooled LED lamp which comprises the following components: an LED chip, an LED chip fixing board, a heat conduction tube, heat radiating fins and a fan. The LED chip is fixed on the LED chip fixing board. The LED chip is connected with the heat radiating fins below the LED chip through the heat conduction tube. The heat conduction tube is internally provided with heat transfer medium. The fan is provided below the heat radiating fins. Because the structure of the utility model is adopted, on a condition of same power, the air-cooled LED lamp has the following advantages: high heat radiation speed, high brightness, good color temperature, long service life and simple structure.

Another application revealed by the patent search is the Korean patent application No. KR20130061142 dated Apr. 21, 2011. The abstract of this application is as follows: A liquid cooled LED lighting device includes a sealed housing containing an LED element that emits light. Cooling liquid is contained in the housing to disperse heat generated by the LED element. An enclosure containing compressible material is preferably immovably positioned within the housing and outside of the optical path of the emitted light. The enclosure containing the compressible material compresses in response to expansion of the cooling liquid as it absorbs heat from the LED element. Advantageously, the cooling liquid and the enclosure containing the compressible material act to more efficiently cool the LED element, thereby providing higher light output and increased lifetime of the LED element.

As a result, due to the drawbacks mentioned above and the inadequacy of the existing solutions regarding the subject matter, it is required to make a development in the related technical field.

BRIEF SUMMARY OF THE INVENTION

The invention, developed by being inspired by the existing conditions, aims to solve the aforementioned drawbacks.

The object of the invention is to cool down LED lamps in an efficient manner, to increase the durability and the amount of tight to be obtained from LED lamps, and to reduce the weight thereof.

The greatest advantage of the embodiment according to the invention is that it eliminates local temperature difference (local hotspots) in LED chips. Local temperature, difference results both from the problems in packaging of the chips, and non-uniform electron distribution in chips. Moreover, thanks to the present invention, the problem of local hot spots formed in the phosphor layer, or in phosphor particles will be solved. Another advantage of the invention is that it reduces the thermal resistance between the chip and heat sink to a great extent when compared to other systems.

The embodiment according to the invention is suited for being used both in LEDs with high brightness producing white light, and in LEDs with different colors (blue, red, green, etc.).

In the state of the art, hot spots are also formed in the material adjusting/controlling the color of light, the so called phosphor, and this reduces quantum efficiency (light intensity). Thanks to the cooling system according to the invention, phosphortemperature will be controlled and light extraction (i.e. lumen extraction) efficiency will be increased.

The design of the embodiment according to the invention is easy to apply and is lower in cost when compared to the active cooling methods. Further, in the present embodiment, a smaller heat sink will be sufficient, instead of using a bigger one, with the superior cooling effect thereof.

Natural circulation of the cooling fluid in liquid or gaseous form within the embodiment according to the invention will continue in itself as long as the lamp operates, thereby achieving an efficient cooling without any extra power. In cases when natural convection is not sufficient, the system will be enabled to operate efficiently by taking the heat from hot spots (chip and/or phosphor) to the base or fins of the heat sink where heat rejection will be performed by means of a micro-or meso-size pump.

In the technique according to the invention, unlike the existing embodiments, the present cooling system is aimed to be integrated with the system. In the patent applications made on LED fluid cooling techniques, the heat is removed from the chip and is limited to a plastic material (or any light-transmitting material) having a semi-globe shape, or any geometrical shape. In the embodiment according to the invention, however, ideas on heat rejection have been developed. Thanks to the cooling system according to the invention, the heat will be taken from the chip and phosphor, and will be made to reach to the heat sink (i.e. heat rejecting block), with the effect of naturally formed termosyphone or forced convection (by means of a pump). Moreover, other electronic and control sensors provided on the system called light engine will thus be cooled down, as well. More light extraction and extending lifetime of the light source is anticipated as double-effect output.

The structural and characteristic aspects and all advantages of the present invention will be more clearly understood by means of the figures given below and the detailed description written with reference to these figures; therefore, while making an evaluation, this detailed description should be taken into account.

DESCRIPTION OF PART REFERENCES

Figure 1:
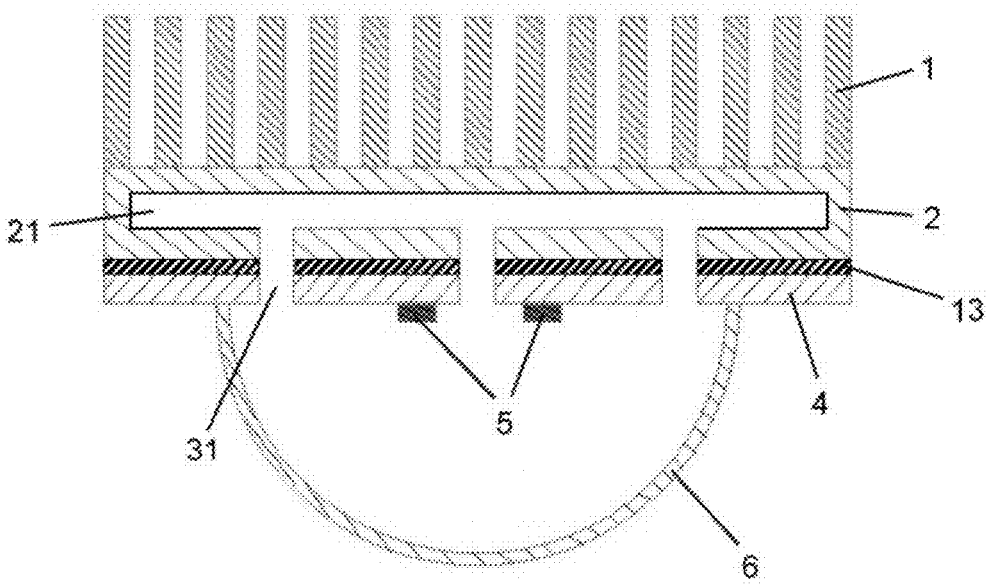
FIG. 1 is the view showing the horizontal flowing channels within the lighting system according to the invention.

1. Heat sink fins
101. Vertical flowing channel
2. Heat sink base
21. Horizontal flowing channel
22. Intermediate channel
3. Cooling fluid
31. Movement channel
32. Movement direction
4. Printed circuit board
5. LED chip
6. Transparent dome
7. Phosphor
8. Connector
9. Electrical connecting socket (Edison Base, etc.)
10, Fan
11, Micro (MEMS) pump
12, Electronic driver circuit (Driver)
13. Sealing member
14. Connecting cable
MEMS: Microelectromechanical systems
Q: Represents heat exchange The drawings do not necessarily need to be scaled and the details that are not necessary for understanding the present invention may have been neglected. Apart from that, the elements that are at least substantially identical or have at least substantially identical functions are referred with the same numeral.

DETAILED DESCRIPTION OF THE INVENTION

In this detailed description, the preferred embodiments of the lighting system used in indoor or outdoor, or special lighting systems, which is preferably integrated with a liquid-based cooling technique according to the invention will only be described in order for the invention to be better understood.

The lighting system according to the invention comprises heat sink fins (1), a vertical flowing channel (101), heat sink base (2), horizontal flowing channel (21), cooling fluid (3), movement channel (31), printed circuit board (4), LED chip (5), transparent dome (6), phosphor (7), connector (8), electrical connecting socket (9), fan (10), MEMS pump (11), driver (12), and sealing member (13).

The lighting system particularly comprises a cooling system which comprises a heat sink having heat sink fins (1) being directly in contact with the cold environment and a heat sink base (2) which comprises said heat sink fins (1) thereon, gets in full contact with the heated surface and transfers the heat taken therefrom to said heat sink fins (1); and a lighting apparatus having a LED chip (5); said cooling system also comprises: a dielectric cooling fluid (3) which directly contacts with LED chip (5); contacts with the heat sink base (2) by moving towards the heat sink base (2), i.e. upwards, with the decreasing density as a result of the increased temperature due to the high temperature formed in the LED chip (5); at the same time the temperature thereof decreasing upon contacting with the heat sink base (2) and moves towards the LED chip (5), and reduces the temperature of the LED chip (5) by contacting the LED chip (5) upon said movement; and movement channels (31) through which the cooling fluid (3) in gaseous or liquid phase passes during the movement of said cooling fluid (3). The components which allow the lighting system to serve for lighting are as follows: the printed circuit board (4) where said LED chip (5) is located; the transparent dome (6) which transmits the light emitted by the LED chip (5); the phosphor (7) adjusting/controlling the light emitted by said LED chip (5);

the driver (12) limiting the current passing over said LED chip (5); and the electrical connecting socket (9) allowing electrical conduction.

Figure 2:
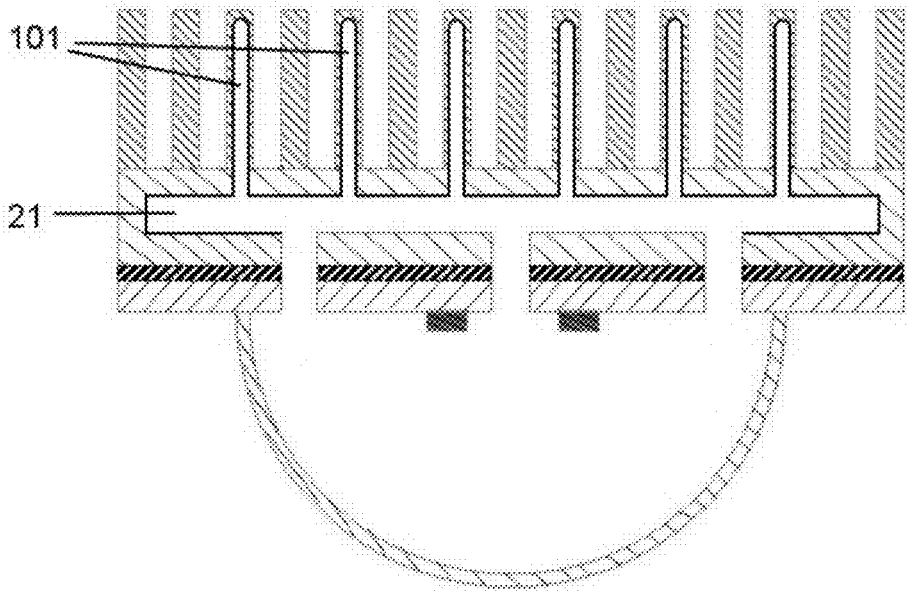
FIG. 2 is the view also showing the vertical flowing channels within the lighting system according to the invention.
Figure 4:
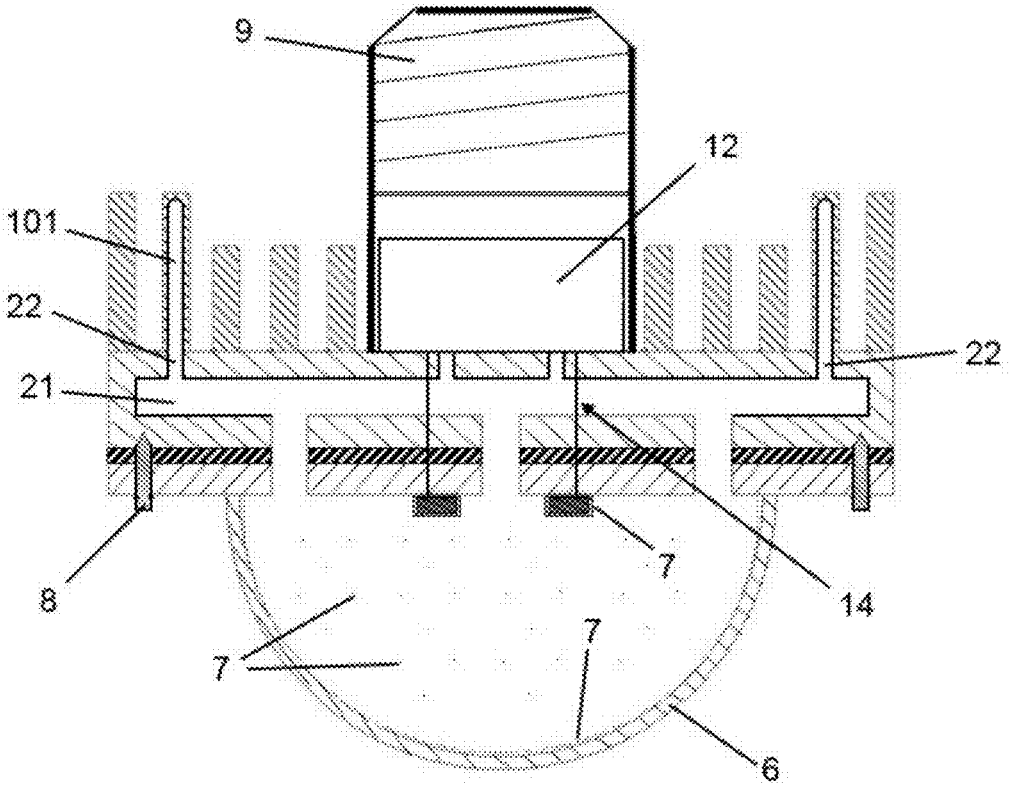
FIG. 4 is the view showing the embodiment in which the vertical flowing channels are located at the ends of the heat sink, and also showing phosphor and driver, within the lighting system according to the invention. Also seen in this figure is Edison base.
Figure 6:
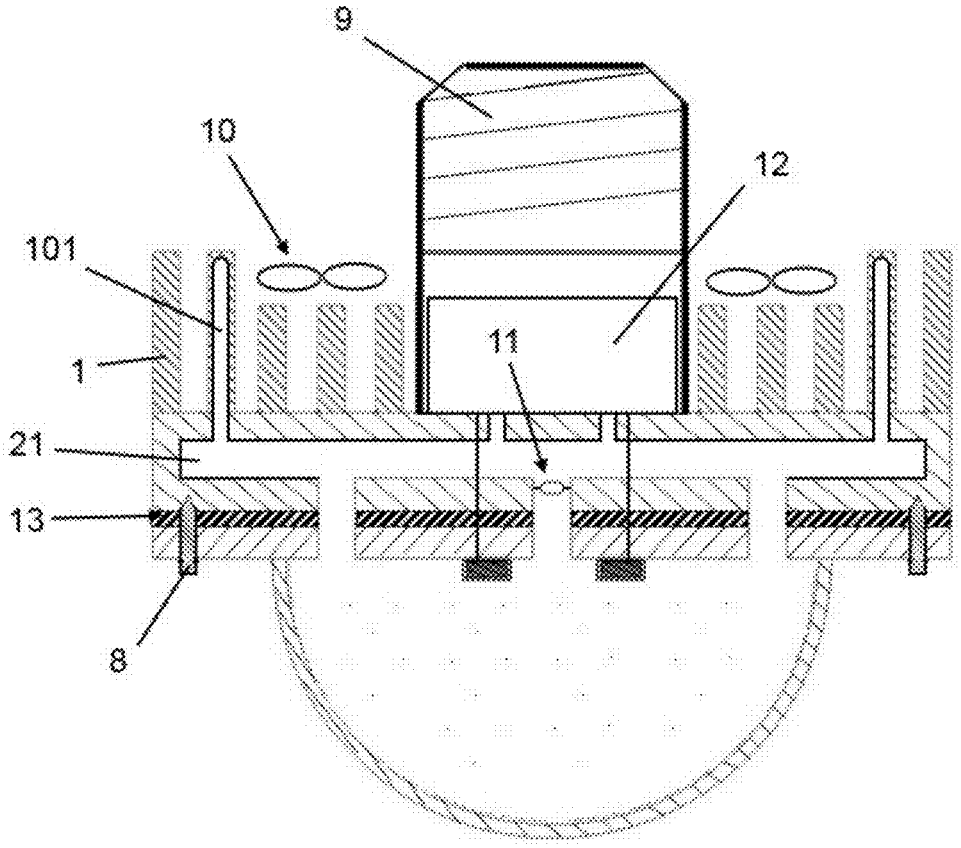
FIG. 6 is the view showing the fans and MEMS pump within the lighting-system according to the invention. The fan is shown representatively.
Figure 7:
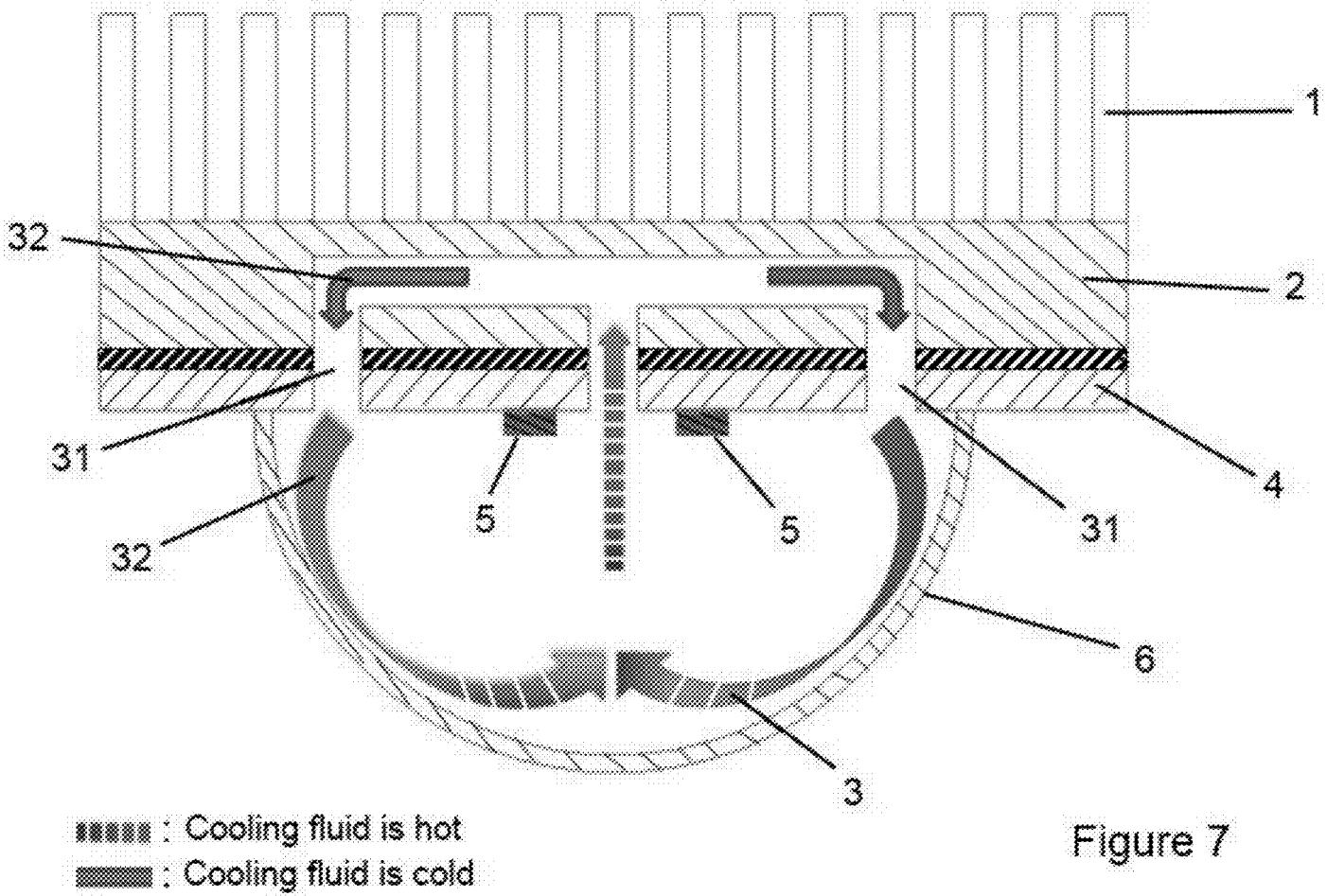
FIG. 7 is the view showing the circulation of the cooling fluid, and the points at which the temperature rises and at which the temperature lowers within the lighting system according to the invention.

The characteristics of the components of the LED embodiment according to the invention will be described below:

Heat sink fins (1): Heat sink fins (1) which are disposed on the heat sink base (2) are the surfaces that directly contact with the cold environment. The surface increase herein provides a wider contact area between the cold environment and hot environment, thereby facilitating heat rejection and providing a more efficient passive cooling effect. Vertical flowing channels (101) can be formed in one, several, or all of the heat sink fins (1) (FIG. 2). In this embodiment, it is also obligatory that intermediate channels (22) which allow the passage of cooling fluid (3) to vertical flowing channels (101) are formed in live heat sink base (2) (FIG. 4). The function of said vertical flowing channels (101) is to enable the cooling fluid (3) to be directed at the end portions of the fins (1), which are the coldest portions, and to allow the contact thereof. Thus, cooling fluid (3) is cooled down more. That said, some of the heat sink fins (1) may be shorter, while some of them may be longer (FIGS. 4 and 6). In this case, the cooling fluid (3) is directed to the side where the fins (1) which are longer than the others, and thus in more contact with cold air, are provided, and it is cooled down there.

Heat sink base (2): Heat sink base (2) gets in full contact with the heated surface and transfers the heat thereon to the heat sink fins (1) used for increasing the surface area, and holds the heat sink fins (1) together. Horizontal flowing channels (21) may be formed in the heat sink base (2), at the side areas thereof (FIGS. 1 and 2). The function of said horizontal flowing channels (21), as in the vertical flowing channels (101), to direct the cooling fluid (3) to the edges of the heat sink base (2) which are colder, and to cool down the cooling fluid (3).

Cooling fluid (3): The cooling fluid (3) does not conduct electricity; that is, it has dielectric property, but at the same time having light transmitting property. The reason why the cooling fluid (3), whose specific heat capacity is higher than that of the air, is not provided with electrical conductivity is that short circuits likely to occur are desired to be prevented.

Printed circuit board (4): Printed circuit boards (4) are the ones oh which circuit components are soldered and where electrical connections are provided by means of copper traces (FIG. 1). The boards within the state of the art are generally the ones made of epoxy plates (FR4), or the metal based ones (metalclad board). However, since heat rejection is important in the embodiment according to the invention, metal printed circuit board (4), the heat conductivity of which is higher, is preferred.

Figure 3:
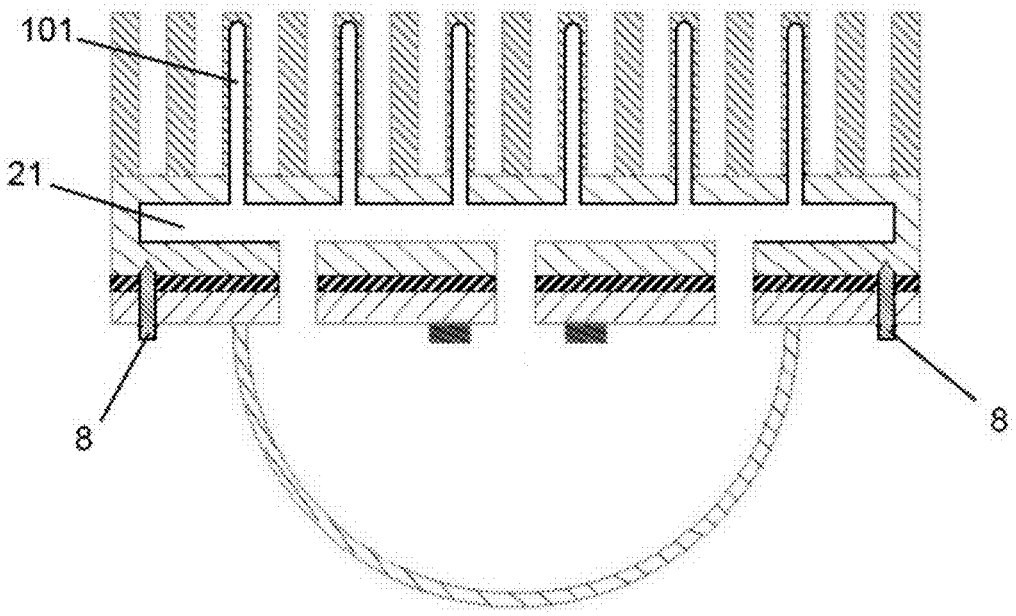
FIG. 3 is the view also showing the connectors within the lighting system according to the invention.

Sealing member (13): A sealing member (13) is provided between the printed circuit board (4) and heat sink base (2) (FIG. 1). The sealing member (13) balances the heat difference between the heat sink base (2), which is cold, and the printed circuit board (4), which is hot. The sealing member (13) is preferably made of plastic, rubber, polyurethane or a similar material. Said heat sink base (2) provides the connection between the sealing member (13) and printed circuit board (4), preferably by means of elements such as screw or bolt and nut, known in the art (FIGS. 3 and 4).

LED chip (5): LED chip (5) is the part which provides light to the outside, doe to which it causes heating up in the environment (FIG. 1). Heat increase adversely affects the operation of itself; besides causing undesired influences on the system. Hence, it most be cooled down.

Transparent dome (6): The transparent dome (6) prevents the cooling fluid (3) having dielectric property and used for cooling purpose in the system from getting out of the structure (FIG. 1). Moreover, it has light transmitting property and provides light transmission thanks to the transparent structure thereof.

Figure 5:
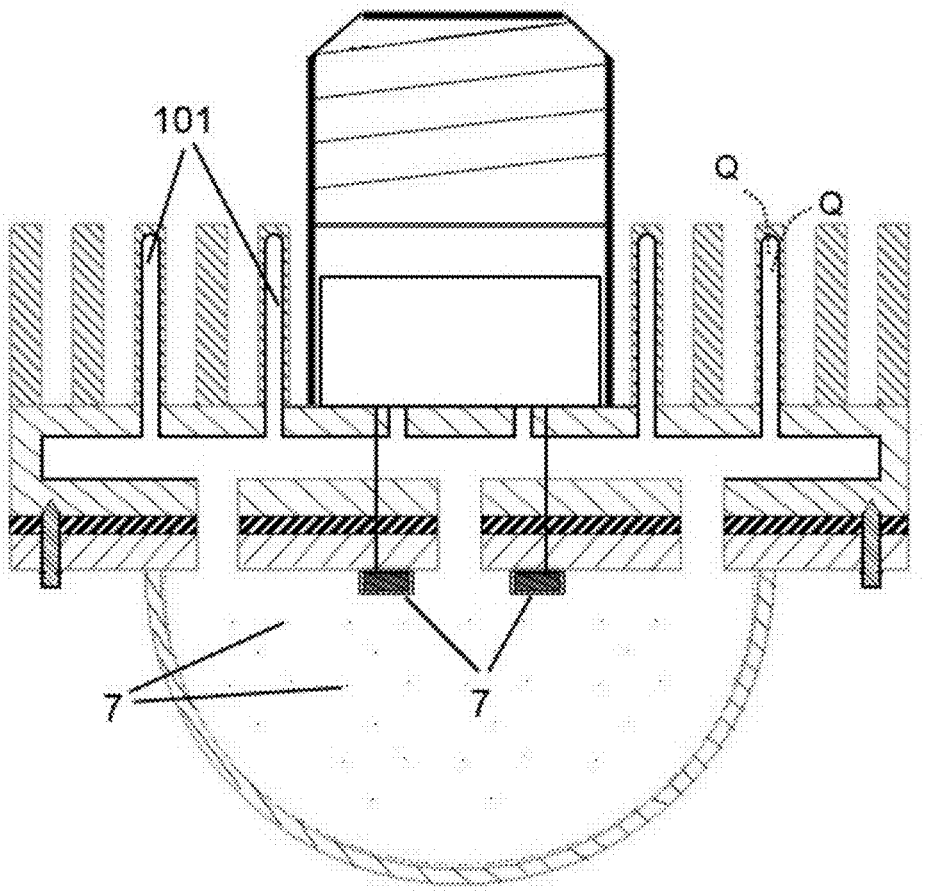
FIG. 5 is another view showing the lighting system according to the invention.

Phosphor (7): Hot spots are formed in the phosphor (7), which is the material adjusting/controlling the Color of light, and this reduces quantum efficiency (light intensity). In the embodiment according to the invention, phosphor (7) can be used in different variations. It may be present in the lower surface of the transparent dome (6) in some embodiments, on the LED chip (5) in some other embodiment, or inside the transparent dome (4) in another embodiment in a dispersed manner (FIGS. 4 and 5). Apart from that, each one of said three circumstances can be applied in the same embodiment. The idea mentioned in this application includes these three states of phosphor (7), and the derivatives thereof. Phosphor (7) may be present in the form of layer or particle. The cooling fluid (3) cools down said phosphor (7), which is in the form of layer or particle. Thus, the problem of local hot spot formation in phosphor (7) is solved; and phosphor temperature can be controlled and light extraction efficiency can be increased.

Driver (12): The driver (12) limits the current passing on the LED chip (5). The electrical conduction between the driver (12) and LED chip (5) is accomplished by means of the connecting cables (14) (FIG. 4).

Fan (10): The fans (10) can be located on heat sink fins (1) in alternative embodiments of the invention. Since the fins (1) cooled by the fan (10) will be colder than the fins (1) that are not cooled by the fan (10), the cooling fluid (3) is directed to the fins (l) cooled by the fan (10), and if vertical flowing channel (101) is present in the fin (1), it is directed to said vertical flowing channels (101) (FIG. 6).

In the embodiment according to the invention, a dielectric (i.e. not conducting electricity) cooling fluid (3) which directly contacts with LED chips (5) located on the metal circuit board (4) having a better heat conductivity than other standard lamps is used. This, in turn, provides a better cooling when compared to the gases used for heat rejection in standard lamps.

The cooling system according to the invention operates as follows: First, thanks to the design of the embodiment, the cooling fluid (3), which is heated due to the high temperature formed in the transparent dome (6) and on the LED chip (5), and the density of which reduces relatively with respect to the other areas, passes through the movement channels (31) between the LED chips (5) and heat sink base (2) in the movement directions (32) and moves upwards, i.e. towards the heat sink base (2), and then contacts with the heat sink base (2). After this contact, the temperature of the cooling fluid (3) decreases while the density thereof increases, and the cooling fluid moves downwards, i.e. towards the LED chips (5), again by passing through the movement channels (31) in movement directions (32). After this movement, the cooling fluid (3) contacts with LED chips (5) and decreases the temperature of the LED chip (5). Thus, the LED chips (5) is/are cooled down by the cooling fluid (3). Afterwards, when the temperature of the LED chip (5) increases, the steps explained above are repeated. This natural cycle continues in itself as long as the LED lamp operates, and thanks to this occurrence which provides heat rejection, it is achieved within the present system without using any extra power (pumps, fans, etc.).

After the cooling fluid (3) contacts with the heat sink base (2) as mentioned in the above paragraph, the heat sink fins (1) which are disposed on the heat sink base (2) perform heat rejection since they directly contact with the cold environment. Thanks to the heat sink fins (1), the heat sink base (2) remains cold permanently.

In the cooling system according to the invention, if horizontal flowing channels (21) are formed, the cooling fluid (3) is directed towards these sections and cooling occurs in this area, as well (FIG. 1). Similarly, if vertical flowing channels (101) are formed, the cooling fluid (3) is directed towards vertical flowing channels (101) and heat rejection is performed in this area.

Figure 8:
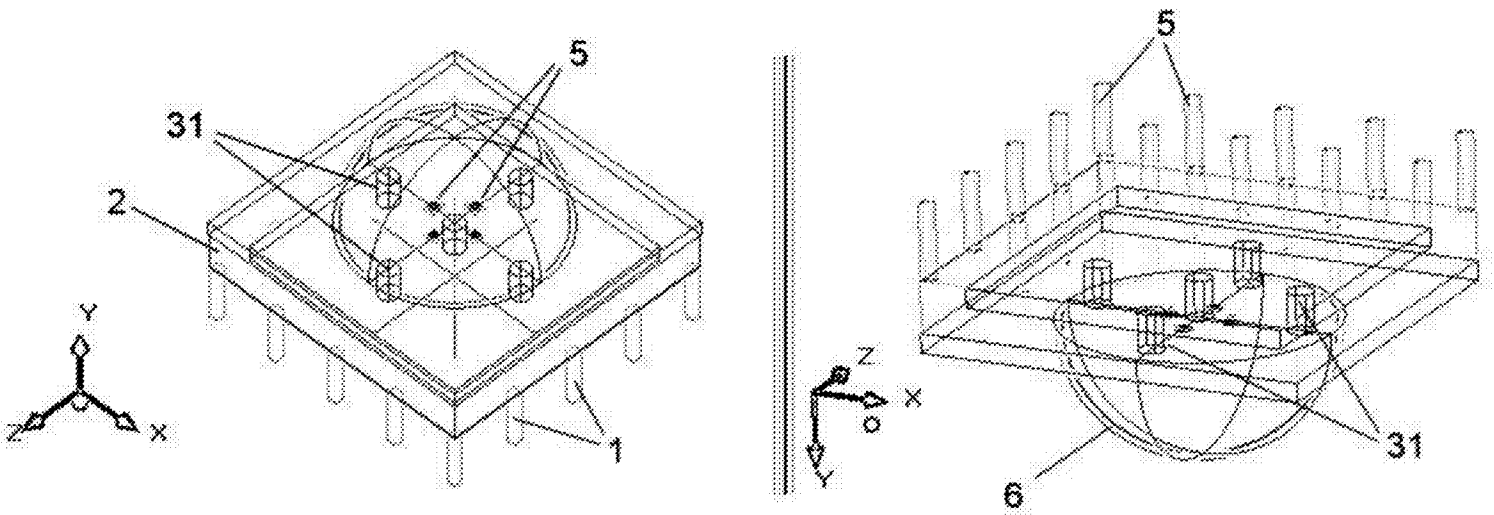
FIG. 8 is the perspective view showing the LED embodiment according to the invention, as well as showing the internal structure.

In FIG. 8, the perspective views also showing the internal structure of the LED embodiment according to the invention are given. As seen, the transparent dome (6) has hemisphere-estructure. Moreover, the locations of the movement channels (31) and LED chips (5) can be seen more clearly in these figures.

In the lighting system according to the invention, the cooling fluid (3) is also capable of cooling down the driver (12).

In the lighting system according to the invention, the electrical connecting socket (9) is preferably Edison base; wherein it is adaptable to other mounting systems known in the art.

The lighting system according to the invention is applicable to standard indoor (i.e. interior design) lamps such as A19, Par38, and MR16, and it is also suitable for being used in other lamps with different form factors. In addition, it is suitable for next generation lamps, besides standard outdoor lamps.

In the lighting system according to the invention, said cooling fluid (3) may be in the form of gas or liquid.

In an alternative embodiment of the invention, said lighting system may be provided with or without a pump. In the embodiment with pump to be used in eases when natural convection is not sufficient, the system will be enabled to operate efficiently by taking the heat from hot spots (LED chip (5) and/or phosphor (7)), to the heat sink base (2) and heat sink fins (1) where heat rejection will be performed by means of a micro-or meso-size pump, preferably an MEMS pump (11). The MEMS pump (11) is preferably located between LED chips (5). Hence, the cooling fluid (3) having been cooled down is directed onto the LED chips (5) by the MEMS pump (11) in a forced manner, and thus the LED chips (5) are cooled down more efficiently.

We claim:

1. A lighting system comprising;

a lighting assembly having an LED chip on a printed circuit board; and a cooling system comprising:

a heat sink having a heat sink base and heat sink fins, said heat sink base having a first flowing channel, at least one of said heat sink fins having a second flowing channel, said heat sink fins adapted to directly contact with an environment, said heat sink base being in thermal contact with a heated surface so as to transfer heat to said heat sink fins;

a dielectric cooling fluid directly contacting said LED chip, said dielectric cooling fluid moving toward said heat sink base so as to have a decreasing density resulting from an increased temperature of said dielectric cooling fluid caused by said LED chip, said dielectric cooling fluid passing through said first and second flowing channels and then moving toward said LED chip; and a plurality of movement channels through said printed circuit board between said LED chip and said heat sink base , said dielectric cooling fluid passing through said plurality of movement channels in a gaseous or liquid phase during the movement of said dielectric cooling fluid.

2. The lighting system of claim 1, further comprising:

a transparent dome adapted to transmit light emitted by said LED chip;

a phosphor adjusting or controlling the light emitted by said LED chip;

a driver which limits a current passing on said LED chip; and an electrical connecting socket providing electrical conduction.

3. The lighting system of claim 2, wherein said electrical connecting socket is an Edison base socket.

4. The lighting system of claim 2, wherein the lighting system is compatible with indoor lamps.

5. The lighting system of claim 2, wherein said phosphor is located at a location selected from the group consisting on a lower surface of the transparent dome, on the LED chip, and inside the transparent dome in a dispersed manner.

6. The lighting system of claim 2, further comprising:

a sealing member positioned between said heat sink base and said printed circuit board, said sealing member balancing a heat difference between the heat sink base and the printed circuit board.

7. The lighting system of claim 1, wherein a heat capacity of said dielectric cooling fluid is higher than a heat capacity of air.

8. The lighting system of claim 1, wherein said printed circuit board has conductivity.

9. The lighting system of claim 1, wherein said cooling system further comprises:

a MEMS pump which directs the dielectric cooling fluid towards the LED chip.

10. The lighting system of claim 1, wherein said cooling system further comprises:

a vertical flowing channel which is formed inside said heat sink fins and in which the dielectric cooling fluid circulates; and an intermediate channel which allows the passage of said dielectric cooling fluid to said vertical flowing channel.

11. The lighting system of claim 10, wherein said vertical flowing channels are formed in at least one of said heat sink fins.

12. The lighting system of claim 10, wherein each of said heat sink fins has a different length.

13. The lighting system of claim 1, wherein said cooling system further comprises:

a plurality of horizontal flowing channels which are formed inside said heat sink base and in which the dielectric cooling fluid circulates.

14. The lighting system of claim 1, wherein said cooling system further comprises:

at least one fan directed to said heat sink fins so as to cool said heat sink fins.

15. The lighting system of claim 1, wherein said LED chip is an LED chip that produces white light.

16. A lighting system comprising:

a lighting assembly including an LED chip mounted within an enclosure on a first side of a printed circuit board (PCB); and a cooling system comprising:

a heat sink having a heat sink base and heat sink fins, wherein the heat sink base is in thermal contact with a second side of the PCB opposite the first side;

a first flowing channel within the heat sink base and a second flowing channel within at least one of said heat sink fins, wherein the first and second flowing channels allow for passing of the dielectric cooling fluid through the heat sink; and a dielectric cooling fluid that directly contacts the LED chip on the first side of the PCB and passes through a movement channel in the PCB between the LED chip and the heat sink base, and then passes through the first and second flowing channels within the heat sink on the second side of the PCB.

17. The lighting system of claim 16, further comprising a plurality of flowing channels within the heat sink, wherein the plurality of flowing channels includes a vertical flowing channel within a heat sink fin and a horizontal flowing channel within the heat sink base.

18. The lighting system of claim 16, wherein an opening of the flowing channel is aligned with an opening of the movement channel, and wherein the dielectric cooling fluid circulates upwards from the LED chip towards the heat sink, through a movement channel, through a flowing channel, and then downwards towards the LED chip.

19. A cooling system comprising:

a heat sink having a heat sink base and heat sink fins, wherein the heat sink base is thermally couplable to a printed circuit board (PCB), the PCB having a first side on which an LED chip is mounted within an enclosure, and the PCB having a second side opposite the first side, the second side being thermally couplable to the heat sink base; and a first flowing channel within the heat sink base and a second flowing channel within at least one of said heat sink fins, wherein the first flowing channel is configured to communicate with movement channels through the PCB between the LED chip and the heat sink base for allowing passage of a dielectric cooling fluid that directly contacts the LED chip on the first side of the PCB, passes through at least one of the movement channels of the PCB, and then passes through the first and second flowing channels within the heat sink on the second side of the PCB.

20. The cooling system of claim 19, wherein the flowing channels include a vertical flowing channel within a heat sink fin and a horizontal flowing channel within the heat sink base.

* * * * *